US008683963B2

(12) United States Patent
Kobayashi et al.

(10) Patent No.: US 8,683,963 B2
(45) Date of Patent: Apr. 1, 2014

(54) HYDRAULIC CONTROL DEVICE FOR ENGINE

(75) Inventors: Hideo Kobayashi, Mishima (JP); Toshihisa Sugiyama, Gotemba (JP); Kenichi Yamada, Yaizu (JP); Shusaku Sugamoto, Susono (JP); Bunki Kawano, Shizuoka-ken (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/376,880

(22) PCT Filed: Jun. 8, 2009

(86) PCT No.: PCT/JP2009/060455

§ 371 (c)(1),
(2), (4) Date: Feb. 2, 2012

(87) PCT Pub. No.: WO2010/143252

PCT Pub. Date: Dec. 16, 2010

(65) Prior Publication Data

US 2012/0132172 A1 May 31, 2012

(51) Int. Cl.
*F01P 1/04* (2006.01)

(52) U.S. Cl.
USPC ..... 123/41.35; 123/196 R

(58) Field of Classification Search
USPC ..... 123/41.35–41.39, 196 R
See application file for complete search history.

(56) References Cited

U.S. PATENT DOCUMENTS

| | | | |
|---|---|---|---|
| 5,904,226 | A | 5/1999 | Sakaguchi et al. |
| 2009/0229561 | A1 | 9/2009 | Yamashita et al. |

FOREIGN PATENT DOCUMENTS

| | | | |
|---|---|---|---|
| JP | 55-130006 | U | 3/1979 |
| JP | 57-89810 | U | 11/1980 |
| JP | 57-126504 | U | 1/1981 |
| JP | 60-15907 | U | 2/1985 |
| JP | 60-52342 | U | 4/1985 |
| JP | 60-128917 | A | 7/1985 |
| JP | 60-252116 | | 12/1985 |
| JP | 62-078423 | A | 4/1987 |
| JP | 07-259525 | A | 10/1995 |
| JP | 08-093430 | A | 4/1996 |
| JP | 10-212916 | A | 8/1998 |
| JP | 2002-195016 | A | 7/2002 |
| JP | 2006-249940 | A | 9/2006 |
| JP | 2007-040148 | A | 2/2007 |
| JP | 2007-107485 | A | 4/2007 |
| JP | 2008-025403 | A | 2/2008 |
| JP | 2009-097372 | A | 5/2009 |

OTHER PUBLICATIONS

U.S. Appl. No. 12/090,188, filed Oct. 13, 2006, Yamashita, et al.
Office Action dated Jul. 25, 2013 in corresponding Chinese Patent Application No. 200980160783.7.
European Search Report dated Oct. 4, 2013 issued in European Application No. 09845777.3.

*Primary Examiner* — Noah Kamen
(74) *Attorney, Agent, or Firm* — Sughrue Mion, PLLC

(57) ABSTRACT

A hydraulic control device is equipped with an oil jet that injects oil to a piston, an oil gallery through which oil injected by the oil jet and oil supplied to a lubrication part of an engine pass, an oil pump that pumps oil to the oil gallery, and a switching valve that is provided on an oil jet passage connecting the oil gallery and the oil jet together and leads oil supplied from the oil gallery to either the oil jet or an oil pan disposed at an upstream side of the oil pump. An ECU controls the switching valve on the basis of an engine speed and an engine cooling water temperature.

1 Claim, 4 Drawing Sheets

HYDRAULIC CONTROL DEVICE FOR ENGINE

CROSS REFERENCE TO RELATED APPLICATIONS

This application is a National Stage of International Application No. PCT/JP 2009/060455filed Jun. 8, 2009, the contents of all of which are incorporated herein by reference in their entirety.

TECHNICAL FIELD

The present invention relates to hydraulic control devices for engines.

BACKGROUND ART

There is known a hydraulic control device that supplies oil for lubrication to internal parts of an engine that require lubrication. Such a hydraulic control device is equipped with an oil pump that pressurizes oil for distribution, a relief valve that adjusts oil sending pressure, and passages through which oil is supplied to the parts in the engine. Further, the hydraulic control device injects oil for lubrication to a piston head in order to cool a piston. An exemplary engine that performs the hydraulic control is disclosed in Patent Document 1.

PRIOR ART DOCUMENT

Patent Document

Patent Document 1: Japanese Patent Application Publication No. 2006-249940

SUMMARY OF THE INVENTION

Problems to be Solved by the Invention

Oil used for engine lubrication has a higher viscosity as the temperature of the oil is lower. Thus, the hydraulic pressure at high temperature is higher than that at low temperature. Thus, in a case where the pressure at which oil injection to the piston head is started is set to a hydraulic pressure after the engine is warmed up, the hydraulic pressure at low temperature during warm-up exceeds the pressure at which oil injection is started. As descried above, in a case where the pressure at which oil injection to the piston head is started is set to a hydraulic pressure after the engine is warmed up, oil is injected to the piston during warm-up, and the piston is cooled, which prevents early warm-up.

For example, in a case where the relief pressure of oil in the relief valve is reduced during engine warm-up whereby the pressure in the passage of oil is set equal to lower than the pressure at which oil injection to the piston head is started, injection of oil is suppressed, and cooling the piston is suppressed. However, a reduction in the relief pressure fails to supply oil to parts in the engine that need a supply of oil, and lubrication may be insufficient. If an injection valve of injecting oil to the piston head is forcibly stopped, the pressure in the passage of oil increases and the load on the oil pump increases.

Accordingly, the present invention has an object of supplying oil to parts in an engine necessary for lubrication and suppressing oil injection to a piston during engine warm-up to expedite warm-up.

Means for Solving the Problems

A hydraulic control device for an engine that achieves the object is characterized by comprising: an oil jet injecting an oil to a piston; an oil passage through which oil injected by the oil jet and oil supplied to a lubrication part of an engine flow; an oil pump pumping the oil to the oil passage; an oil jet passage connecting the oil passage and the oil jet together; an oil lubrication passage connecting the oil passage and the engine lubrication part together; and switching means, disposed on the oil jet passage, for selectively supplying the oil to the oil jet through the oil jet passage and returning oil to an upstream side of the oil pump on the basis of an operating condition of the engine.

The above switching means may be configured to have a switching valve that has a channel for supplying the oil to the oil jet through the oil jet passage, and a channel for returning an upstream side of the oil pump, and a control part that controls the switching valve on the basis of an operating condition of the engine.

The hydraulic control device of the present invention stops a supply of oil to the oil injection means by the switching means in a case where there is no need to supply the oil to a piston head. Thus, the hydraulic control device is capable of suppressing cooling the piston head during engine warm-up. Therefore, it is possible to realize an early temperature rise of the piston head during the engine warm-up.

Further, since the pressure of oil in the oil passage, oil is stably supplied to parts to be lubricated.

Effects of the Invention

The hydraulic control device for engines is capable of stopping oil injection to a piston during engine warm-up and expediting warm-up.

EMBODIMENTS FOR CARRYING OUT THE INVENTION

Now, a description is given of modes for carrying out the invention with reference to the drawings.

Figure 1:
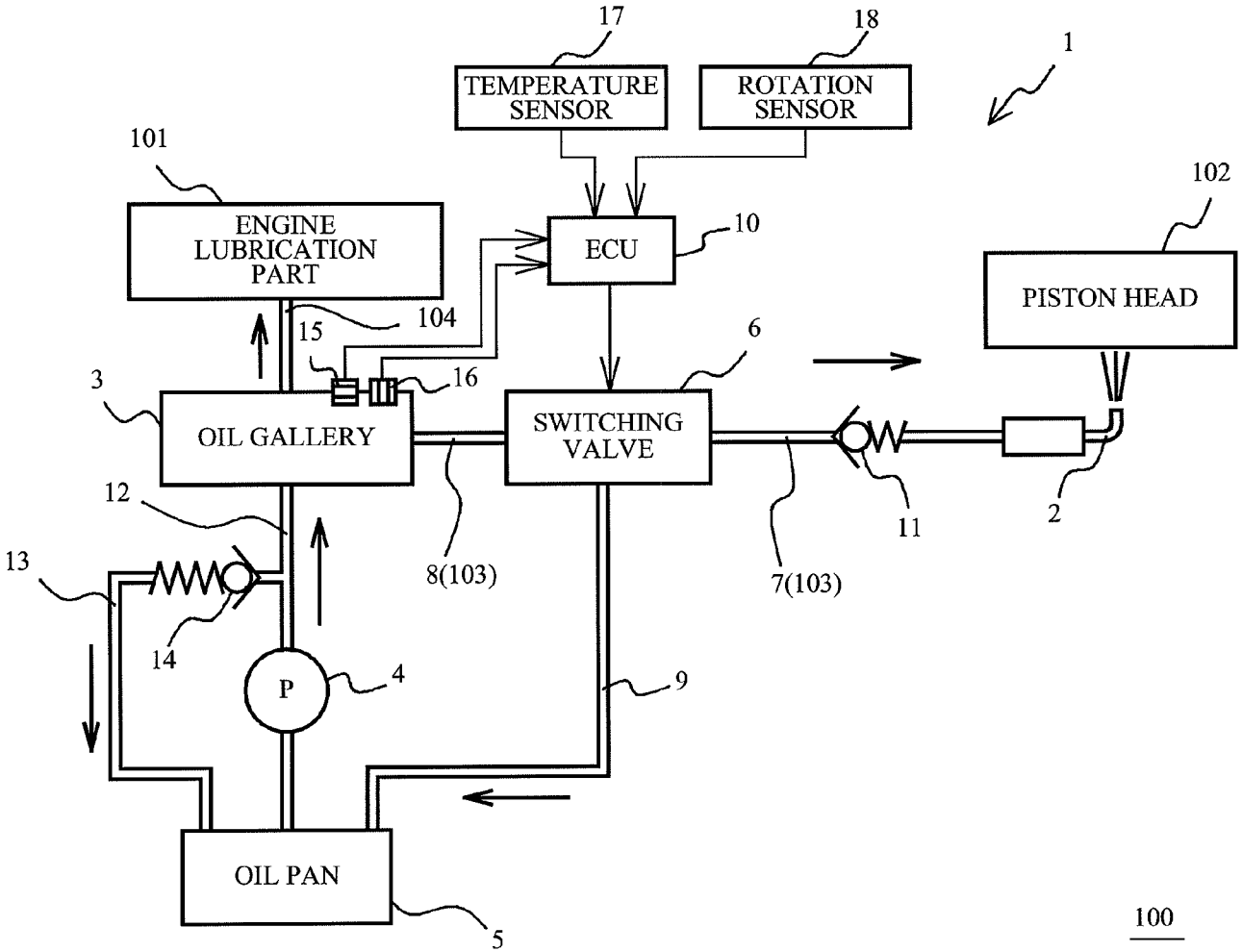
FIG. 1 is a descriptive diagram of an outline structure of an engine in which a hydraulic control device is incorporated.

FIG. 1 is a descriptive diagram of an outline structure of an engine 100 in which a hydraulic control device 1 of an embodiment is incorporated. The hydraulic control device 1 is equipped with an oil jet 2, an oil gallery 3, and an oil pump 4.

In the present embodiment, oil is supplied to a lubrication part 101 of the engine 100, and is used as a lubricant. The oil jet 2 injects such oil to a piston head 102 of the engine 100. The oil injected takes heat of the piston head 102, which is thus cooled. The oil gallery 3 is a passage of oil injected by the oil jet 2 and oil supplied to the lubrication part 101 of the engine 100, and is capable of reserving oil. The oil gallery 3 corresponds to an oil passage of the invention. The oil pump H4 pumps oil in an oil pan 5 that stores oil to the oil gallery 3.

The hydraulic control device 1 has an oil jet passage 103 that connects the oil jet 2 and the oil gallery 3 together, and an oil lubrication passage 104 that connects the oil gallery 3 and the engine lubrication part 101. A switching valve 6 is disposed on the oil jet passage 103. A part of the oil passage 103 between the switching valve 6 and the oil jet 2 is defined as a first passage 7, and another part thereof between the switching valve 6 and the oil gallery 3 is defined as a second passage 8. The switching valve 6 is connected to the oil pan 5 located at the upstream side of the oil pump 4 by a third passage 9.

The switching valve 6 switches a connection between the first passage 7 and the second passage 8 and a connection between the second passage 8 and the third passage 9. Oil in the oil gallery 3 passes through the second passage 8, and is supplied to the switching valve 6. The oil supplied to the switching valve 6 is sent to either the first passage 7 or the third passage 9. That is, the switching valve 6 leads the oil supplied from the oil gallery 3 to either the oil jet 2 or the oil pan 5 provided at the upstream side of the oil pump 4. The switching valve 6 shunts off a channel connected to the first passage 7, and shunts off a channel connected to the third passage 9. That is, the switching valve 6 shuts off an oil flow channel from the oil gallery 3 to the oil jet 2 and an oil flow channel that is disposed at the upstream side of the oil pump 4 and is connected to the oil pan 5.

Figure 2A:
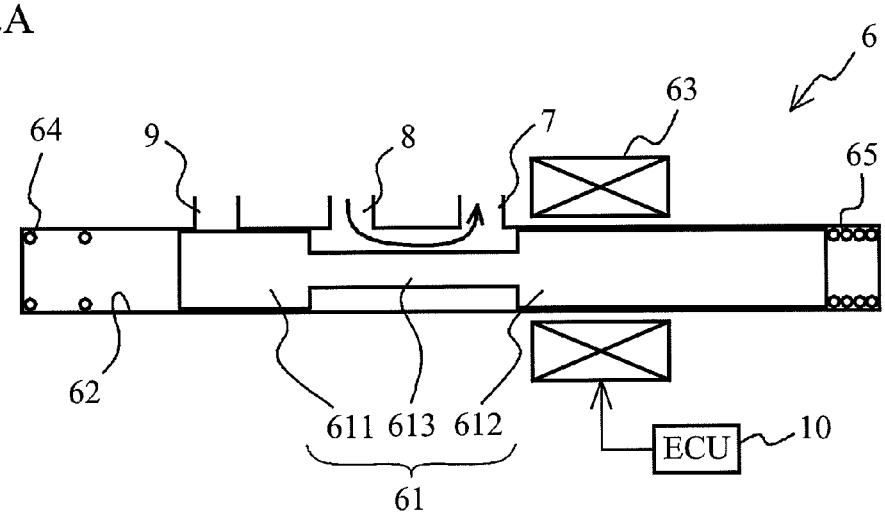
FIGS. 2(*a*) through 2(*c*) are a descriptive diagrams of an inner structure of a switching valve.
Figure 2B:
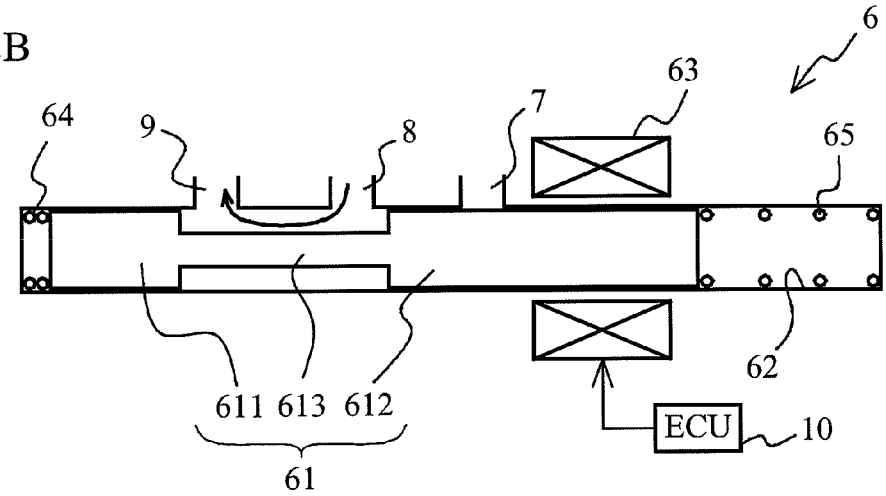

Next, the structure of the switching valve 6 is described in detail. FIGS. 2(*a*) through 2(*c*) illustrate an inner structure of the switching valve 6. FIG. 2(*a*) illustrates a state in which the switching valve 6 connects the first passage 7 and the second passage 8 to each other, FIG. 2(*b*) illustrates a state in which the switching valve 6 connects the second passage 8 and the third passage 9 to each other, and FIG. 2(*c*) illustrates a state in which the switching valve 6 shuts off both the channel to the first passage 7 and that to the third passage 9.

The switching valve 6 has a valve body 61 shaped into a piston, and a cylinder 62 in which the valve body 61 slides. The valve body 61 has large-diameter portions 611 and 612, and a small-diameter portion 613 provided between the large-diameter portions 611 and 612. A spacing is formed between the wall surface of the small-diameter portion 613 of the valve body 61 and the wall surface of the cylinder 62, and oil is movable through the spacing. The valve body 61 is configured to slide in the cylinder 62 by causing a current to pass through an electromagnetic coil 63 provided on an outer circumference side of the cylinder 62. Springs 64 and 65 are attached to both ends of the cylinder 62, and adjusts the movement of the valve body 61. The electromagnetic coil 63 is electrically connected to an ECU (Electronic control unit) 10.

Figure 2C:
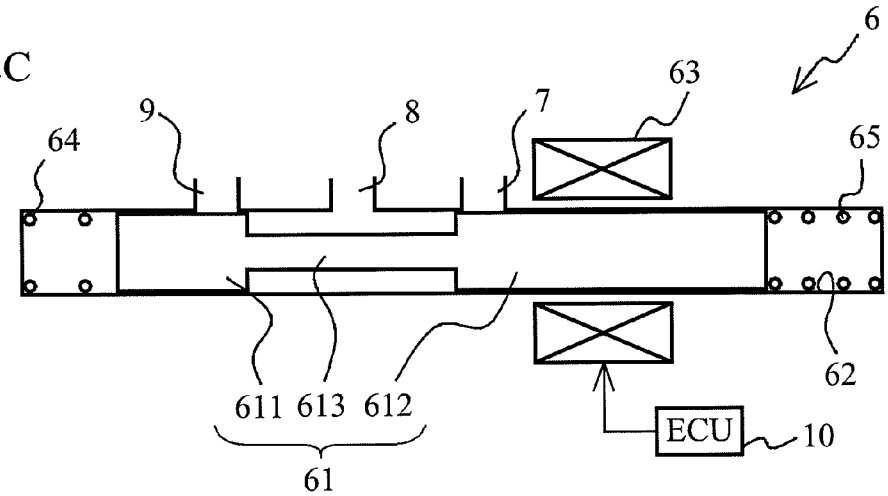

In a case where the amount of current through the electromagnetic coil 63 by the ECU 10 is a first amount of current, the switching valve 6 is in the state of FIG. 2(*a*). When the amount of current through the electromagnetic coil 63 is a second amount of current, the switching valve 6 is in the state of FIG. 2(*b*). When the amount of current through the electromagnetic coil 63 is a third amount of current, the switching valve 6 is in the state of FIG. 2(*c*). As illustrated in FIGS. 2(*a*) through 2(*c*), the valve body 61 moves in the cylinder 62, and the small-diameter portion 613 moves accordingly. Thus, as illustrated in FIG. 2(*a*), in the case where the small-diameter portion 613 moves towards the spring 65, the first passage 7 and the second passage 8 are interconnected. As illustrated in FIG. 2(*b*), in the case where the small-diameter portion 613 moves towards the spring 64, the second passage 8 and the third passage 9 are interconnected. As illustrated in FIG. 2C, in a case where the large-diameter portion 611 of the valve 61 closes a port connected to the third passage 9 and the large-diameter portion 612 closes a port connected to the first passage 7, both the channel to the first passage 7 and that to the third passage 9 are shut off. The above switching between the channels is controlled by the ECU 10 that controls the amount of current supplied to the electromagnetic coil 63. The ECU 10 and the switching valve 6 correspond to switching means of the invention.

As illustrated in FIG. 1, a check valve 11 is disposed on the first passage 7. The check valve 11 opens when the pressure of oil on the upstream side of the first passage 7, that is, the pressure of oil on the side of the first passage 7 closer to the switching valve 6 exceeds 150 kPa, and allows the oil to flow to the oil jet 2. The check valve 11 may be removed. The hydraulic control device 1 has a fourth passage 12 that connects the oil pump 4 and the oil gallery 3 together, and a fifth passage 13 that branches from the fourth passage 12. The other end of the fifth passage 13 is connected to the oil pan 5, and oil that flows through the fourth passage 12 is partly returned to the oil pan 5. A relief valve 14 is disposed on the fifth passage 13. The relief valve 14 opens when the pressure of oil in the fourth passage 12 exceeds 500 kPa and allows the oil in the fifth passage 13 to flow to the oil pan 5. The relief valve 14 is adjusted so that the pressure of oil in the oil gallery 3 is equal to or lower than 500 kPa.

The hydraulic control device 1 has a temperature sensor 15 that measures the temperature of oil in the main gallery 3, a pressure sensor 16 that measures the pressure of oil in the main gallery 3, a water temperature sensor 17 that measures the temperature of a cooling water of the engine 100, and a rotation sensor 18 that measures the engine speed of the engine 100. These sensors are electrically connected to the ECU 10, and items of information measured are sent to the ECU 10. The ECU 10 performs the following control on the basis of the items of information.

Figure 3:
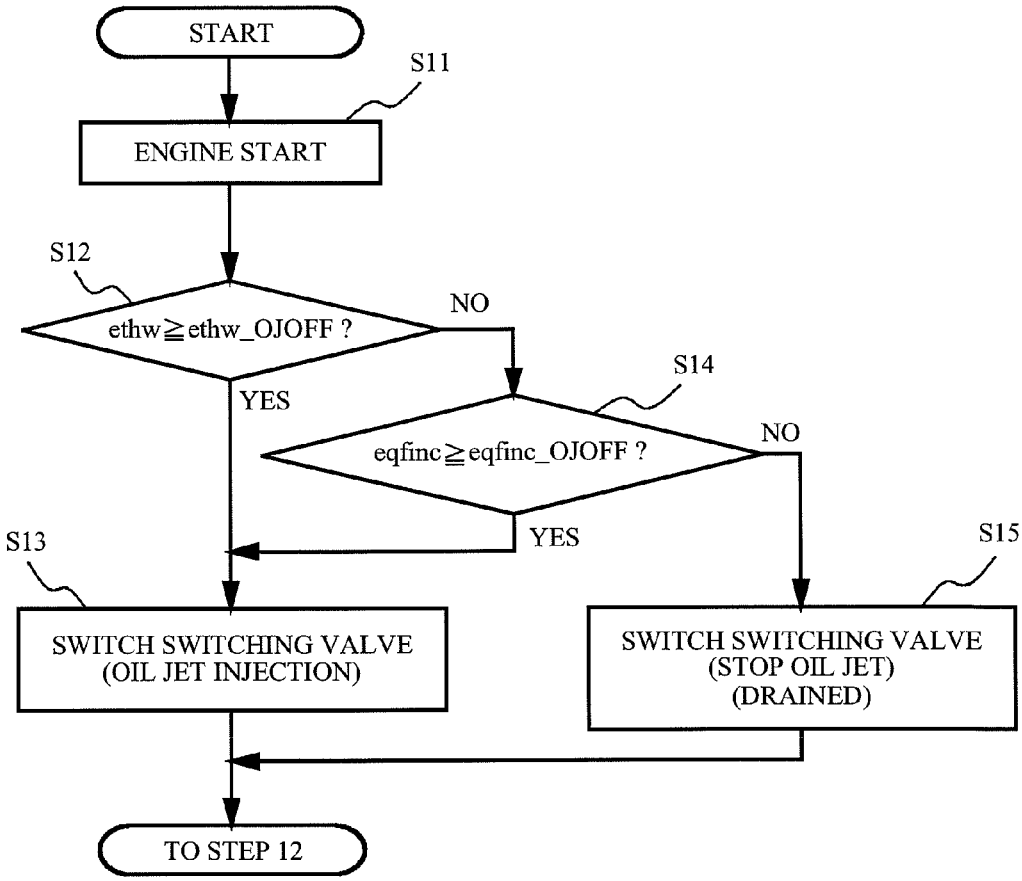
FIG. 3 is a flow chart of a switching control of oil jet injection.

Next, a switching control of oil jet injection is described. FIG. 3 is a flowchart of a switching control of oil jet injection. The switching control of the oil jet injection is performed by the ECU 10, which starts the switching control of the oil jet injection when the ignition is turned on.

At step S11, the ECU 10 starts the engine 100. After finishing the process of step S10, the ECU 10 proceeds to step S12.

At step S12, the ECU 10 determines whether an engine cooling water temperature ethw is equal to or higher than a threshold value ethw_OJOFF. The threshold value ethw_OJOFF may be a temperature after the warm-up of the engine 100 is complete. In a case where the ECU 10 determines that the answer of step S12 is YES, that is, in a case where the engine cooling water temperature ethw is equal to or higher than the threshold value ethw_OJOFF, the ECU 10 proceeds to step S13.

At step S13, the ECU 10 sets the amount of current supplied to the electromagnetic coil 63 of the switching valve 6 to the first amount of current, and thereby switches over the switching valve 6. Accordingly, the switching valve 6 connects the first passage 7 and the second passage 8 together, and oil supplied from the oil gallery 3 is sent to the first passage 7. At this time, when the pressure of the oil in the first passage 7 exceeds 150 kPa, the check valve 11 is opened, and oil is thus injected towards the piston head 102 from the oil jet 2. When completing the process of step S13, the ECU 10 proceeds to step S12.

In contrast, in a case where the ECU 10 determines that the answer of step S12 is NO, that is, in a case where the engine cooling water temperature ethw is lower than the threshold value ethw_OJOFF, the ECU 10 proceeds to step S14.

At step S14, the ECU 10 determines whether an instructed injection amount eqfinc is equal to or larger than a threshold value eqfinc_OJOFF. It is now assumed that the engine is being operated under a heavy load when the instructed injection amount is equal to or larger than the threshold value eqfino_OJOFF. Since the engine is being operated under a heavy load, the piston head 102 is required to be cooled. In a case where the ECU 10 determines that the answer of step S14 is YES, that is, in a case where the instructed injection amount eqfinc is equal to or larger than the threshold value eqfinc_OJOFF, the ECU 10 proceeds to step S13. In contrast, in a case where the ECU 10 determines that the answer of step S14 is NO, that is, in a case where the instructed injection amount eqfinc is lower than the threshold value eqfinc_OJOFF, the ECU 10 proceeds to step S15.

At step S15, the ECU 10 sets the amount of current supplied to the electromagnetic coil 63 of the switching valve 6 to the second amount of current, and thereby switches over the switching valve 6. Accordingly, the switching valve 6 connects the second passage 8 and the third passage 9 together, and oil supplied from the oil gallery 3 is sent to the third passage 4 and is returned to the oil pan 5 (in a drained state). When completing the process of step S15, the ECU 10 proceeds to step S12.

In the above switching control to the oil jet injection, when the ECU 10 determines that the engine cooling water temperature does not reach the warm-up complete temperature and the engine is being operated under a light load, the ECU 10 stops supplying oil to the oil jet 2 and returns the oil to the oil pan 5. Thus, cooling the piston head 102 is suppressed and the warm-up of the piston head 102 is expedited. As a result, the warm-up of the engine 100 is expedited whereby the fuel economy is improved, and the exhaust temperature is raised early whereby the exhaust emission is improved. Sine the oil in the oil gallery 3 is returned to the oil pan 5, the hydraulic pressure does not rise excessively and a damage of the pipe or the like is suppressed. It is possible to stably supply oil to the engine lubrication part 101.

Next, other embodiments are described. In a range in which the temperature of oil in the hydraulic control device 1 is high and the engine speed is low, the pressure of oil in the oil gallery 3 decreases excessively by injecting oil to the piston head 2 or returning oil to the oil pan 5. This brings about a shortage of oil supplied to the engine lubrication part 101, and the operation may be defective or the temperature may rise excessively. An embodiment described here secures a minimum hydraulic pressure in the hydraulic control device 1. The structure of the engine 100 into which the hydraulic control device 1 is incorporated is the same as the structure of the above-described embodiment.

Figure 4:
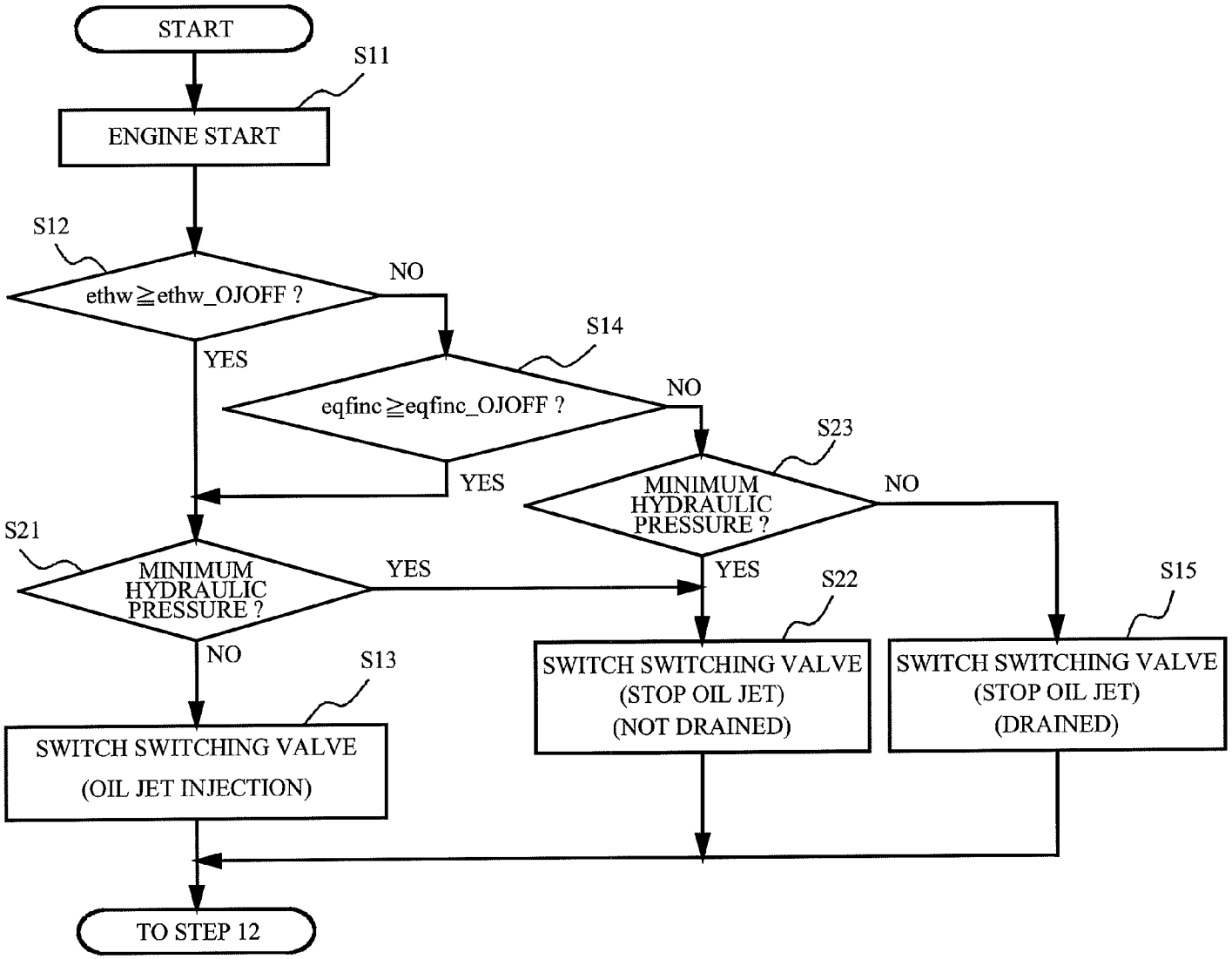
FIG. 4 is a flowchart of securing a minimum hydraulic pressure and a switching control of performing oil jet injection.

A description is now given of a switching control to secure the minimum hydraulic pressure. FIG. 4 is a flowchart of securing the minimum hydraulic pressure and a switching control to perform oil jet injection. The switching control to the oil jet injection is performed by the ECU 10, which starts the switching control to the oil jet injection when the ignition is turned on. In the flowchart of FIG. 4, processes that are the same as those of the flowchart of FIG. 3 are given the same step numbers, and a description thereof is omitted here.

In a case where the ECU 10 determines that the answer of step S12 is YES, that is, in a case where the engine cooling water temperature ethw is equal to or higher than the threshold value ethw_OJOFF, the ECU 1 proceeds to step S21. In a case where the ECU 10 determines that the answer of step S14 is YES, that is, in a case where the instructed injection amount eqfinc is equal to or larger than the threshold value eqfinc_OJOFF, the ECU 10 proceeds to step S21.

At step S21, the ECU 10 determines whether the minimum hydraulic pressure control should be carried out. The minimum hydraulic pressure control is a control to maintain the minimum hydraulic pressure in order to prevent oil to the engine lubrication part 101 from falling in a short supply. Here, on the basis of the engine speed and the temperature of oil in the main gallery 3, it is determined whether the minimum hydraulic pressure control should be carried out. A detailed process is as follows. The engine speed Ne and the oil temperature OT in the main gallery 3 are measured. In a case where the measured engine speed Ne is equal to higher than a speed r at which a hydraulic pressure at the measured oil temperature OT can be secured, the ECU 10 determines that the minimum hydraulic pressure control should be carried out. The temperature of oil may be that of oil in the first passage 7. In a case where the ECU 10 determines that the answer of step S21 is YES, that is, in a case where the minimum oil hydraulic control should be carried out, the ECU 10 proceeds to step S22.

At step S22, the ECU 10 sets the amount of current supplied to the electromagnetic coil 63 of the switching valve 6 to the third amount of light, and thereby switches over the switching valve 6. The switching valve 6 shuts off both the channel to the first passage 1 and the channel to the third passage 9 (not drained). As a result, the oil in the oil gallery 3 is not supplied to the oil jet 2 and is not returned to the oil pan 5. It is thus possible to suppress reduction in the pressure of the oil in the oil gallery 3. Suppression of reduction in the pressure of the oil in the oil gallery 3 secures oil supplied to the engine lubrication part 101, and suppresses the occurrence of a malfunction and an excessive temperature rise of the engine lubrication part 101. After finishing the process of step S22, the ECU 10 proceeds to step S12.

In a case where it is determined that the answer of step S21 is NO, that is, in a case where it is determined that there is no need to perform the minimum hydraulic pressure control, the ECU 10 proceeds to step S13 at which oil is injected to the piston head 102 by the oil jet 2.

In a case where the ECU 10 determines that the answer of step S14 is NO, that is, in a case where the instructed injection amount eqfinc is smaller than the threshold value eqfinc_OJOFF, the ECU 10 proceeds to step S23.

At step S23, the ECU 10 determines whether the minimum hydraulic pressure control should be carried out. The process of step S23 is similar to that of step S21. Here, the details of the process are omitted.

In a case where the ECU 10 determines the answer of step S23 to be YES, that is, in a case where the minimum hydraulic pressure control should be carried out, the ECU 10 proceeds to step S22. In contrast, in a case where the ECU 10 determines that the answer of step S23 to be NO, that is, in a case where there is no need to perform the minimum hydraulic control, the ECU 10 proceeds to step S15.

The decision as to whether the minimum hydraulic control at steps S21 and S23 should be carried out may be made on the basis of the pressure of oil in the main gallery 3. In this case, when the pressure of oil in the main gallery 3 is lower than 150 kPa, it is determined that the minimum hydraulic control should be performed, whereas when the pressure of oil in the main gallery 3 is equal to or higher than 150 kPa, it is determined that there is no need to perform the minimum hydraulic control. When the pressure of oil is equal to or higher than a predetermined value (150 kPa in the present example), oil can be supplied to the engine lubrication part 101 sufficiently.

Further, the decision as to whether the minimum hydraulic control at steps S21 and S23 should be carried out may be made on the basis of the engine speed and the engine cooling water temperature. In this case, it is determined that the minimum hydraulic control should be carried out in a case where the engine speed Ne is equal or lower than a threshold value Ne' and the engine cooling water temperature ethw is equal or higher than a threshold value ethw_OP. In contrast, in a case where the engine speed Ne is higher than the threshold value Ne' or the engine cooling water temperature ethw is lower than the threshold value ethw_OP, it is determined that there is no need to carry out the minimum hydraulic control. The criterion for the determination is based on a fact such that the hydraulic decreases as the engine speed decreases. Further, the above criterion for the determination is based on a fact such that since the engine 100 has been warmed up, the oil temperature has risen sufficiently, whereby the viscosity of the oil decreases and the pressure of the oil decreases.

As described above, the switching control to secure the minimum hydraulic suppresses decrease in the hydraulic in the oil gallery 3 and prevents shortage of oil supplied to the engine lubrication part 101. Thus, the engine 100 is operated stably.

The above-described embodiments are only examples for carrying out the present invention, and the present invention is not limited to those but the embodiments may be varied within the scope of the present invention, and it is apparent from the above description that various embodiments may be made within the scope of the present invention.

DESCRIPTION OF SYMBOLS

1 hydraulic control device
2 oil jet
3 oil gallery
4 oil pump
5 oil pan
6 switching valve
10 ECU
100 engine
101 engine lubrication part
102 piston head
103 oil jet passage
104 oil lubrication passage

The invention claimed is:

1. A hydraulic control device for an engine, comprising:

an oil jet injecting an oil to a piston;

an oil passage through which oil injected by the oil jet and oil supplied to a lubrication part of an engine flow;

an oil pump pumping the oil to the oil passage;

an oil jet passage connecting the oil passage and the oil jet together;

an oil lubrication passage connecting the oil passage and the engine lubrication part together;

switching means, disposed on the oil jet passage, for selectively supplying the oil to the oil jet through the oil jet passage and returning oil to an upstream side of the oil pump on the basis of an operating condition of the engine:

a rotation sensor that measures an engine speed of the engine; and a water temperature sensor that measures a temperature of a cooling water of the engine, wherein the switching means shuts off a passage of oil from the oil passage to the oil jet and a passage of oil from the oil passage to the upstream side of the oil pump in a case where the engine speed measured by the rotation sensor is equal to or lower than a threshold value and the temperature of the cooling water measured by the water temperature sensor is equal to or higher than a threshold value.

* * * * *